US007093673B2

(12) United States Patent
Stokka

(10) Patent No.: US 7,093,673 B2
(45) Date of Patent: Aug. 22, 2006

(54) DRILLING DEVICE

(75) Inventor: Sigmund Stokka, Sandnes (NO)

(73) Assignee: Badger Explorer ASA, (NO)

( * ) Notice: Subject to any disclaimer, the term of this patent is extended or adjusted under 35 U.S.C. 154(b) by 228 days.

(21) Appl. No.: 10/312,515

(22) PCT Filed: Jun. 26, 2001

(86) PCT No.: PCT/NO01/00270

§ 371 (c)(1),
(2), (4) Date: Dec. 27, 2002

(87) PCT Pub. No.: WO02/14644

PCT Pub. Date: Feb. 21, 2002

(65) Prior Publication Data

US 2004/0011558 A1 Jan. 22, 2004

(30) Foreign Application Priority Data

Jun. 29, 2000 (NO) ..... 20003416

(51) Int. Cl.
*E21B 7/02* (2006.01)

(52) U.S. Cl. ..... 175/40; 175/50

(58) Field of Classification Search ..... 175/40, 175/50, 73, 76; 166/66
See application file for complete search history.

(56) References Cited

U.S. PATENT DOCUMENTS 3,007,534 A * 11/1961 Salnikov et al. ..... 175/104
3,680,645 A 8/1972 Horbach et al.
3,866,678 A * 2/1975 Jeter ..... 340/854.3
3,999,618 A * 12/1976 Farris ..... 175/92
4,043,407 A * 8/1977 Wilkins ..... 175/50
4,193,461 A * 3/1980 Lamberton et al. ..... 175/19
4,271,908 A * 6/1981 Robinson et al. ..... 166/385
4,640,552 A 2/1987 Page
4,679,636 A * 7/1987 Ruhle ..... 175/58
4,885,591 A 12/1989 Page
5,078,218 A 1/1992 Smet
5,168,941 A 12/1992 Krueger et al.
6,047,784 A * 4/2000 Dorel ..... 175/61
6,059,050 A * 5/2000 Gray ..... 175/73

(Continued)

FOREIGN PATENT DOCUMENTS

DE 39 10266 10/1990

(Continued)

OTHER PUBLICATIONS

DWPI Abstract, RU 2013514 Abstract, Electrothermal, rotary drilling tool-comprises cylindrical part of height exceeding that of parabolic working head, 1991.

(Continued)

*Primary Examiner*—William Neuder
(74) *Attorney, Agent, or Firm*—Andrus, Sceales, Starke & Sawall LLP

(57) ABSTRACT

Method of introducing instruments/measuring equipment/tools into formations (9) in the earth's crust or other solid materials, such as ice, by means of a drilling device (1), material being liberated by, for example, rotation of a drill bit (2), or by melting, for example by means of a heating element, the liberated material thereafter flowing, or being pumped, past/through the drilling device (1) and being deposited in the bore hole (18) above/behind the drilling device (1). A drilling device (1) for practising the method described above, comprising necessary components, for example a drill bit (2), a driving motor (4), and a steering/control component (7), the drilling device (1) being provided with a cable magazine (10) containing a cable (12), and possibly with an output feeder (11).

20 Claims, 4 Drawing Sheets

U.S. PATENT DOCUMENTS 6,296,066 B1 * 10/2001 Terry et al. ..... 175/92

FOREIGN PATENT DOCUMENTS

EP 110182 6/1984

FR 2697283 A1 * 4/1994

OTHER PUBLICATIONS

DWPI Abstract, SU1620581, Electrically heated drilling bit—ensures ice penetration with line heater and normally closed contact pair plates, 1988.

* cited by examiner

DRILLING DEVICE

CROSS REFERENCE TO RELATED APPLICATION

The present application is the U.S. national stage application of International Application PCT/NO01/00270, filed Jun. 26, 2001, which international application was published on Feb. 21, 2002 as International Publication WO 02/14644. The International Application claims priority of Norwegian Patent Application 20003416, filed Jun. 29, 2000.

SUMMARY OF THE INVENTION

This invention concerns a method of subsurface investigations or investigation of ice, and a device for practicing the method, particularly to be applied when exploring for hydrocarbon or mineral occurrences.

Exploring for oil and gas and the mapping of such resources is substantially limited by the cost associated with the drilling of exploration wells and delineation/step-out wells, and particularly for offshore projects. As the petroleum activity is moved into deeper waters, the cost of exploration, delineation and mapping increases. Large advances within the fields of seismic methods and improved exploration models have provided increased knowledge about the petroleum occurrences, but the need to penetrate the earth's crust to further explore potential occurrences, still exists. In today's exploration for oil and gas in the earth's crust, a combination of seismic investigations and drilling of wells is utilized, in which measurements of physical parameters are undertaken while drilling and after completion of the drilling. The seismic investigations provide information about where to find the oil or the gas. Well measurements provide information about properties of the formation and the fluids within it. The subsequent production tests provide information about expected production rate, discovery size and properties of the fluid.

As mentioned above, the seismic methods have improved substantially, but they still do not provide sufficient information about the oil- and gas occurrences for resource exploitation to be planned and decided on. Costly exploration and delineation wells must be drilled in order to confirm an assumed discovery, and in order to evaluate the properties of the reservoir.

BRIEF DESCRIPTION OF THE INVENTION

The objective of the invention is to bring into the earth's crust, in a relatively simple and inexpensive way, measuring equipment, to undertake measurements and to transmit measurement data to the user.

In accordance with the invention, the objective is achieved by means of the features disclosed in the following description and in the subsequent patent claims.

By means of its own weight and rotation of a drill bit, a cylindrical device which, in a most simplified embodiment of the invention, comprise a drill bit, a bit driving motor, a control and measuring unit, a cable magazine and possibly a cable output feeder, is arranged to work itself downwards into the earth's crust, concurrently feeding out cable and forming a connection to the earth's surface. Energy for the drilling operation is supplied via said cable extending from the surface. Measured values and control signals are transferred via the same cable. The mass liberated and ground up by the drill bit is led past the device, possibly via a through-going channel/tube in the drilling device, to the bore hole behind/above the device and fills the bore hole at the same time as it forms a fixation for the cable connection fed out to the earth's surface. In some applications, having reached a certain drilling depth, and due to technical reasons pertaining to rheology and gravitation, liberated mass will no longer be pushed out of the bore hole. Not being able to establish the same pre-drill degree of compaction of the drilled and ground up material, a pressure increase about the device must therefore be expected. At a given pressure, depending on the nature of the formation, the mass will penetrate into the neighboring formation in the same way as with prior art hydraulic fracturing.

The above-described most simplified embodiment of the device will only work in exceptional cases, this being due to a need for one or several additional functions, for example a means of bore hole directional steering, a feeder device, a drill percussion hammer, an internal conveyor device for liberated mass, measuring apparatus for measuring, for example, pressure, temperature and drilling direction, all being tested prior art as known per se.

Upon the device having completed the drilling it will normally be left behind within the earth's crust where it may continue transmitting data to the surface.

A further development of the device may comprise the utilization of hydraulic circuits for motive power and control, drill percussion equipment, bore hole sealing units wherein cement or other chemical substances are employed, units for the fracturing of the surrounding formation, and energy supply means other than electricity. Further, the device may be equipped with vibration elements to facilitate the propulsion, and it may carry explosives. The method of communication between the device and the surface may alternatively be based on methods employing fiber optics, electromagnetism or acoustics. In an embodiment of the future, it is conceivable that the device may be reversible and arranged to sample and bring material to the earth's surface.

BRIEF DESCRIPTION OF THE DRAWING

In the following, the method is described together with several non-limiting examples of preferred embodiments of a device arranged to carry out the method. The device is illustrated in the accompanying drawings, wherein.

DETAILED DESCRIPTION OF THE INVENTION

Figure 1:
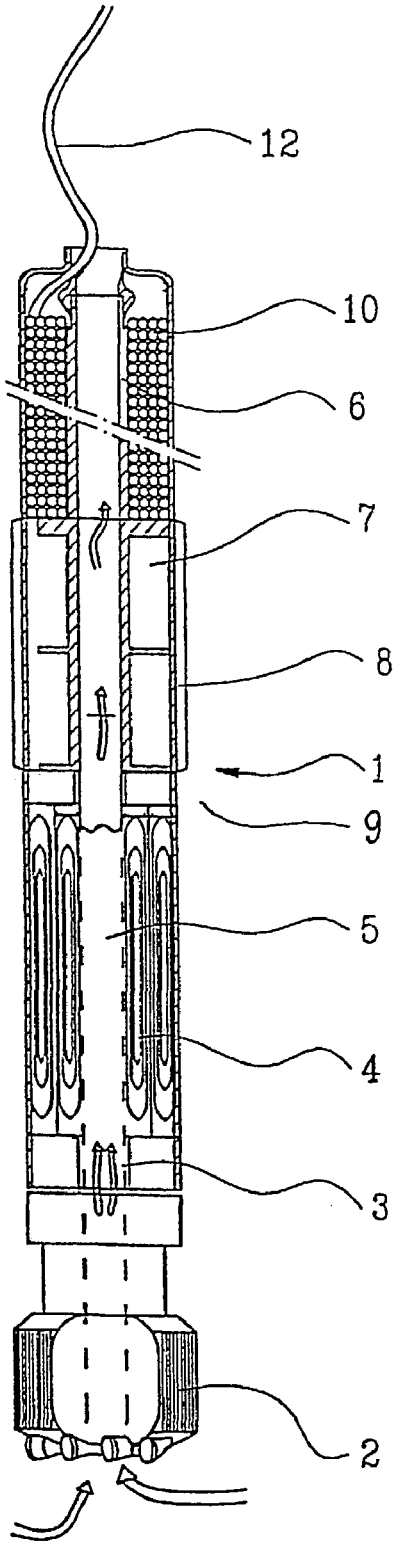
FIG. 1 displays schematically a section of main components of the drilling device.

On the drawings, the reference numeral 1 denotes a drilling device comprising a drill bit 2 which, via a supported rotating and tubular central shaft 3, is connected to an electric driving motor 4. The through-going bore 5 of the central shaft 3 form the lower part of a through-going channel/tube 6 of the drilling device 1. Behind/above the driving motor 4, a steering component 7 is arranged. Besides forming a void for the placing of non-displayed electrical switching equipment and measuring- and communication instruments, the steering component 7 is provided with external, longitudinal and straight ribs 8. The intervention of the longitudinal and straight ribs 8 in a surrounding mass crushed by drilling and a formation 9, is arranged to dampen the rotary motion of the drilling device 1, which rotary motion is caused by the torque of the drill bit 2, thus reducing the resulting torque which initiates rotation of the drilling device 1. Behind/above the steering component 7, a magazine 10 and a controller/output feeder 11 for a cable 12 is arranged. The cable 12 is arranged to be fed out from the magazine 10 as the drilling device 1 proceeds downwards, and to supply from the earth's surface 27 electrical energy to the drilling device 1, concurrently transmitting through the same cable 12 communication between the drilling device 1 and the earth's surface 27. The cable 12 is coiled up within the magazine 10. Via the output feeder 11, the cable 12 is fed out of the magazine 10. The output feeder 11, being manufactured in elastic material, is connected to the upper portion of the through-going channel/tube 6. By feeding out during operation the cable 12 at an angle from the surface of the channel/tube 6, an encircling collar 14 is arranged to prevent the cable 12 from locking around the channel/tube 6. The output feeder 11 is provided with a cylindrical lip 15 which, by means of its contact surface pressure against the end portion 16 of the magazine 10, frictionally counteracts superfluous output of the cable 12 by drilled mass flowing out of the bore hole 18 during drilling.

The drill bit 2 is set in rotational motion by the driving motor 4 and liberates and crushes mass from the bottom 19 of the bore hole 18. Having been mixed with water or another fluid surrounding the drilling device 1, the mass crushed by drilling exhibits the consistency of a viscous mass, and it moves upwards through the channel 6, possibly also through the annulus 17 formed between the exterior cylinder surface of the drilling device 1 and the formation 9 of the earth's crust, by means of being displaced by the higher net weight of the drilling device 1. The drilled mass leaves the drilling device 1 and is deposited in the bore hole 18 above/behind the drilling device 1 where it encloses the cable 12 fed out.

Figure 2:
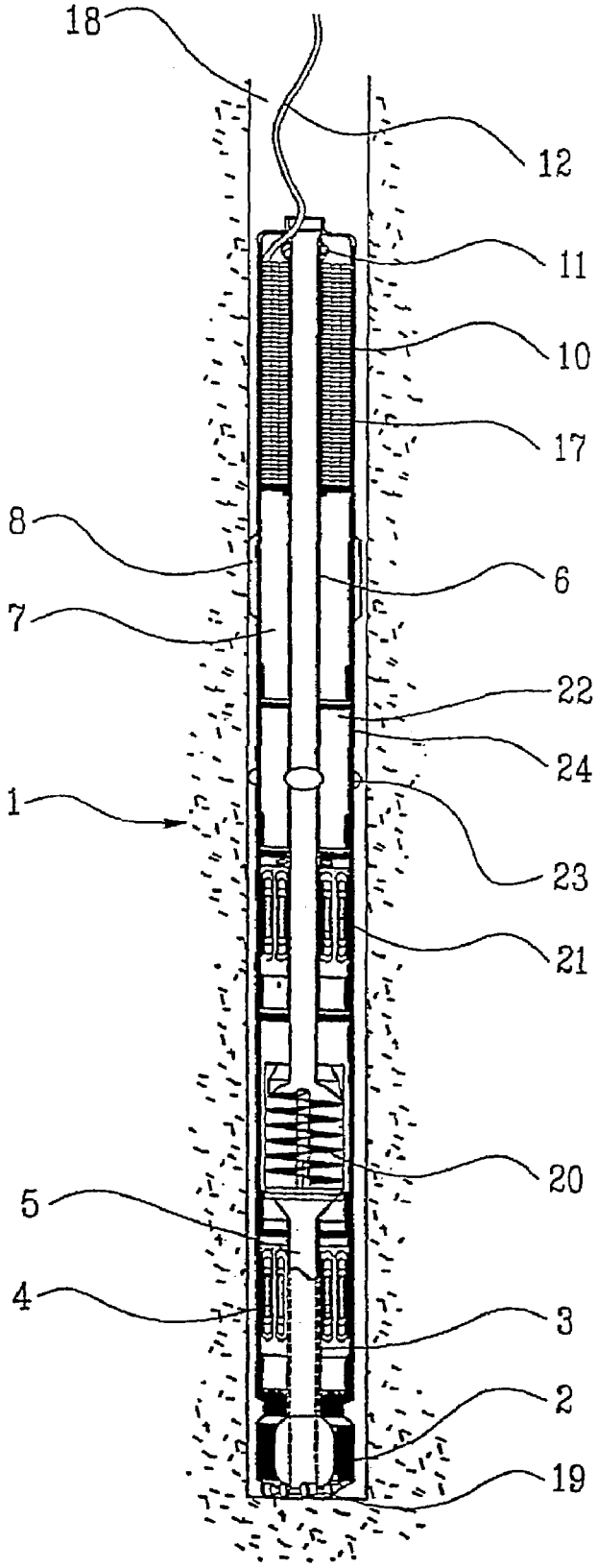
FIG. 2 displays schematically a section of a drilling device provided with several additional functions.
Figure 3:
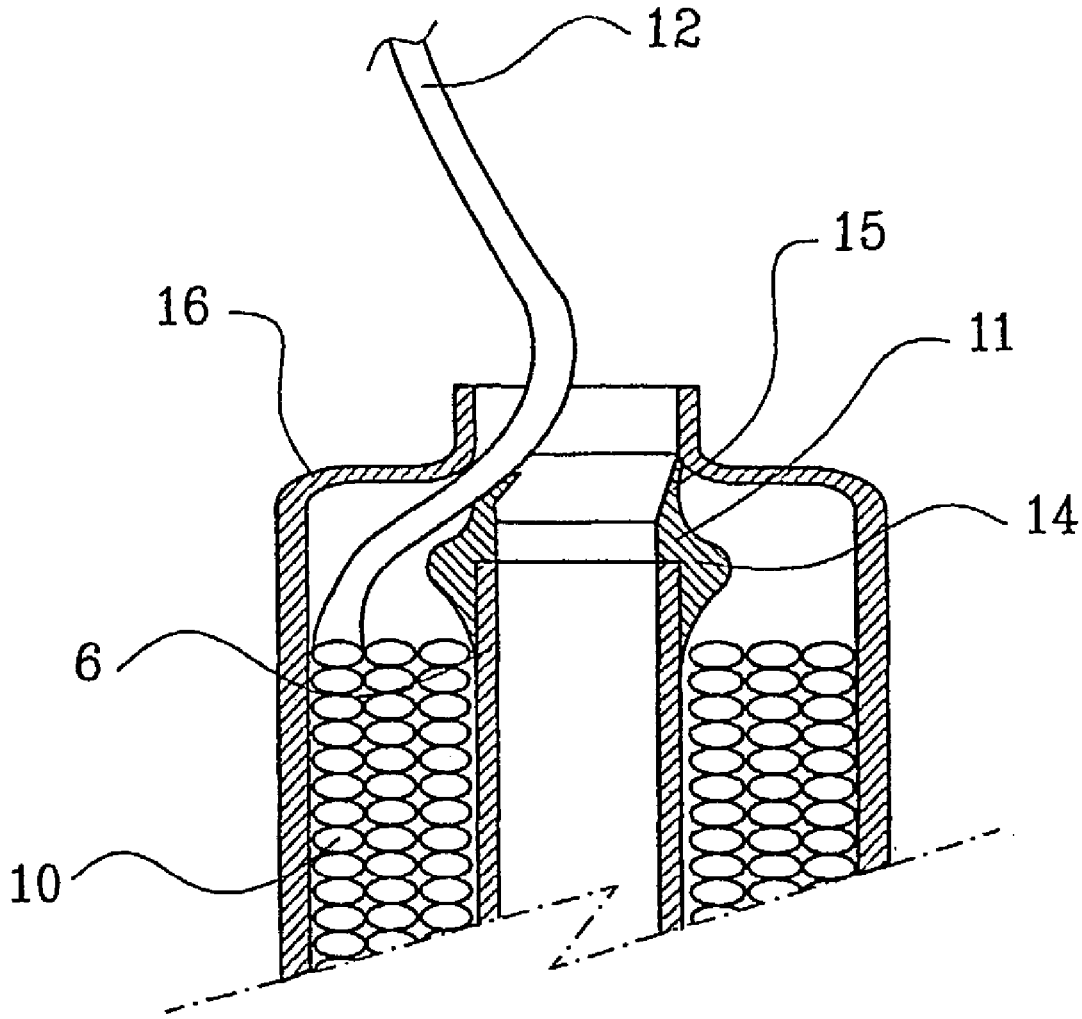
FIG. 3 displays schematically a larger scale section of the cable output feeder.
Figure 4:
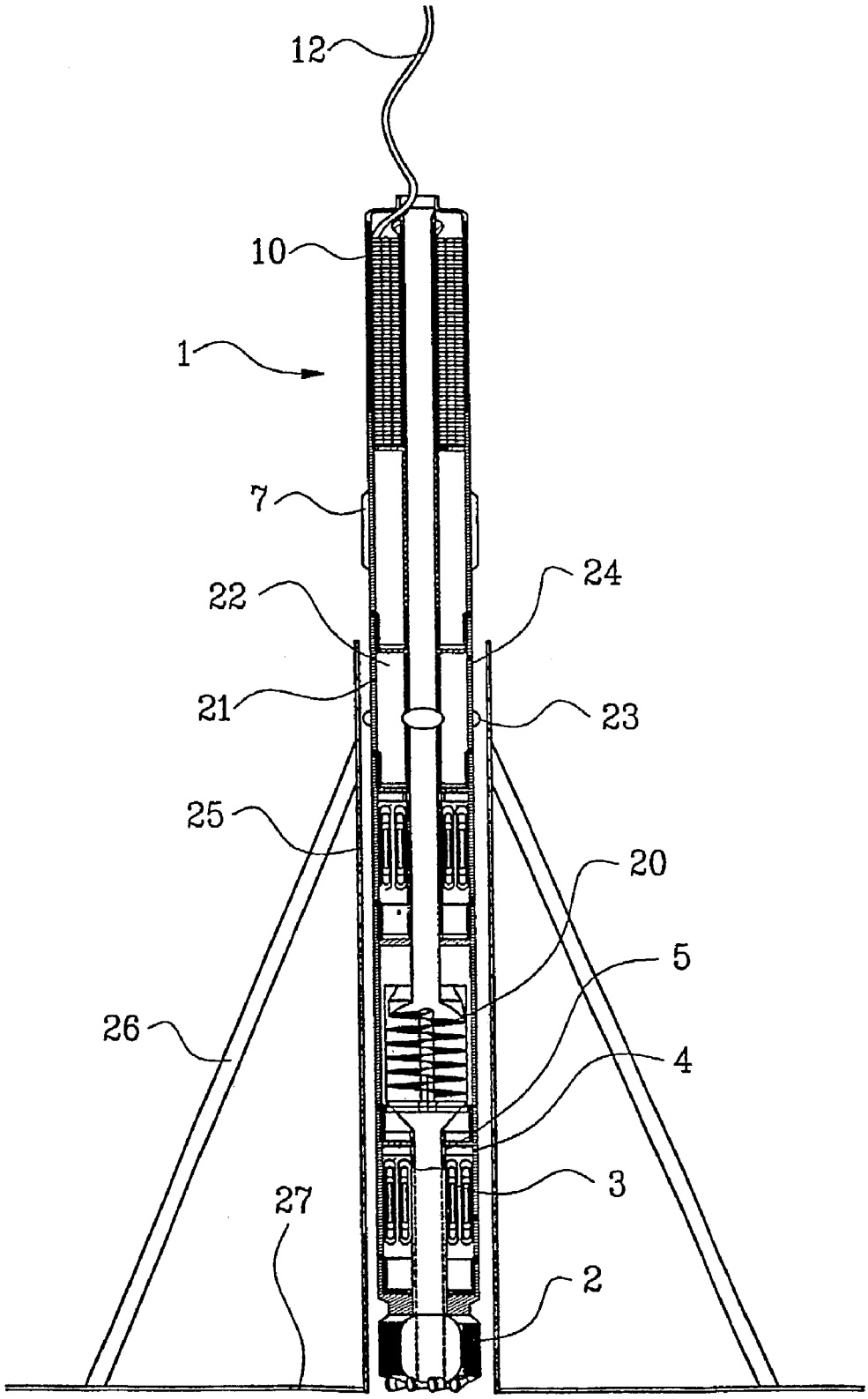
FIG. 4 displays schematically a section of the drilling device placed in a launch pipe.

In another embodiment, see FIGS. 2 and 4, the drilling device 1 is provided with a pump 20, for example a screw pump, which forms a portion of the through-going channel 6. The pump 20 is connected to and runs by an electric motor 21. A directional steering section 22 is provided with four hydraulically and independently operated cup-shaped cylinders 23 arranged to be pressed against the bore hole wall in a specific direction for the purpose of shifting the drilling device 1 in the opposite direction. The drilling device 1 thereby assumes an angle with respect to the center line of the bore hole 18, and the drilling device 1 continues to drill at a desired deviation angle through the formation 9. For the purpose of moving the drilling device 1 during the drilling, the cylinders 21 are connected to a component 24 as known per se, and displayed in no detail, the component 24 being axially moveable relative to the drilling device 1. Other known means of providing directional steering, for example and articulated drill bit suspension, may also be used. Other known devices for propelling the drilling device 1 may prove more suitable than the one disclosed above and may become necessary in the potential event of drilling horizontally or at a near-horizontal angle.

Upon applying the method according to the invention, a launch pipe 25 is placed on the earth's surface 27, see FIG. 4, or, alternatively, the drilling device 1 may be inserted in a conventional pre-drilled hole. The launch pipe 25 must be adequately fastened, for example with bars 26, and positioned on the earth's surface 27 such that the drilling device 1 is given a proper starting direction. The drilling device 1 is placed within the launch pipe 25 and the cable 12 is connected to a non-disclosed energy supply/control equipment. The drill bit 2 is then rotated by the driving motor 4 connected thereto. The relatively large mass of the drilling device 1, together with the dampening function of the steering ribs 8, only initiate a slow counter-rotation of the drilling device 1 relative to the direction of rotation of the drill bit 2. After a relatively short period of time, the direction of rotation of the drill bit 2 is reversed, whereby the torque of the driving motor 4 also changes direction. The rotation speed of the drilling device 1 is thereby retarded until the drilling device 1 stops and is thereafter accelerated in the opposite direction of rotation. If the drilling device 1 is provided with a directional steering device 22 with a moveable component 24, the cylinders 23 attached to the moveable component 24 are pushed against the inner wall of the launch pipe 25, and the moveable component 24 moves the drilling device 1 such that the rotating drill bit 2 starts drilling into the minerals of the earth's crust.

During drilling, employing prior art technology, one or more parameters of the machine are measured, such as the orientation of the drilling device 1 relative to the earth's gravitational and magnetic fields, and well parameters such as temperature, pressure, density, water saturation, hydrocarbon saturation, porosity and permeability. Further, permeability tests may be undertaken. Upon completing the drilling, the drilling device 1 may continue to measure well data.

The application of the method according to the invention may significantly reduce the drilling costs of mapping/delineating petroleum occurrences. As contrasted by the prior art, it is therefore possible to gather data from several positions for the purpose of investigating several potential petroleum occurrences, or to improve the mapping of a reservoir. Several potential petroleum occurrences may thus be proven, and a larger portion of a proven reservoir may be recovered. This applies to occurrences both on land and at sea.

The same method and equipment may be used for mineral exploration or mapping, or to investigate other conditions within the earth's crust, for example for general geological mapping or in the exploring of water, or within ice, the choice of parameters to be measured, however, varying with the purpose of the investigation. In order to penetrate ice, the simplest solution will likely consist in melting the ice upon warm-up of a heating element in the drilling device 1. The water above the drilling device 1 will re-freeze, and the cable 12 will be left behind in a sealed hole. In this embodiment of the invention, mapping of possible occurrences of minerals within the liquid or within the surrounding ice, may also be of interest.

The invention claimed is:

1. A method of introducing instruments/measuring equipment/tools into formations in the earth's crust by means of a drilling device, material being liberated by rotation of a drill bit, wherein the drilling device liberates the formation material in front of the drilling device, the liberated material thereafter flowing, or being pumped, past/through the drilling device and being deposited in the bore hole above/behind the drilling device, wherein the drilling device is supplied with sufficient energy to push possible excess volumes of mass into the neighboring formation.

2. The method of claim 1, wherein a cable for energy supply and communication with the drilling device is fed out from the drilling device substantially at the same rate as the drilling device works itself through the formation.

3. The method of claim 2, wherein the drilling device comprises a cable magazine containing a cable, said cable magazine connected to the drilling device and arranged such that the cable retracts from the magazine, and hence the drilling device, as the drilling device and cable magazine penetrate the earth's crust.

4. The method of claim 3, wherein the magazine is provided with an output feeder.

5. The method of claim 4, wherein the output feeder is provided with a circular collar protruding from a channel/tube or an elastic lip engaging an end portion of the cable magazine.

6. The method of claim 1, wherein measuring of physical data and/or mapping is carried out concurrent with the drilling device penetrating the earth's crust, during drill breaks, and after drilling is completed.

7. The method of claim 1, wherein the drilling device is provided with a through-going bore.

8. The method of claim 1, wherein the drilling device is provided with a pump.

9. The method of claim 1, wherein the drilling device comprises a steering and control component.

10. The method of claim 1, wherein the drilling device comprises a driving motor.

11. A method of introducing instruments, measuring equipment or tools into formations in the earth's crust, the method comprising the steps of:

providing an elongated drilling device having a drilling end that comprises a drill bit;

penetrating the formation with the drilling end of the drilling device to liberate formation materials from the formation such that the materials flow past or through the drilling device and close a bore hole left by the drilling device with sufficient pressure to force the materials into the formation.

12. The method of claim 11, wherein a cable for energy supply and communication with the drilling device is fed out from the drilling device substantially at the same rate as the drilling device works itself through the formation.

13. The method of claim 11, wherein measuring of physical data and/or mapping is carried out concurrent with the drilling device penetrating the earth's crust, during drill breaks, and after drilling is completed.

14. The method of claim 11, wherein the drilling device is provided with a through-going bore.

15. The method of claim 11, wherein the drilling device is provided with a pump.

16. The method of claim 11, wherein the drilling device comprises a steering and control component.

17. The method of claim 11, wherein the drilling device comprises a driving motor.

18. The method of claim 11, wherein the drilling device comprises a cable magazine containing a cable, said cable magazine connected to the drilling device and arranged such that a cable retracts from the magazine, and hence the drilling device, as the drilling device and cable magazine penetrate the earth's crust.

19. The method of claim 18, wherein the magazine is provided with an output feeder.

20. The method of claim 19, wherein the output feeder is provided with a circular collar protruding from a channel/tube or an elastic lip engaging an end portion of the cable magazine.

* * * * *